US005901514A

United States Patent [19]

Wolfe

[11] Patent Number: 5,901,514

[45] Date of Patent: May 11, 1999

[54] EXTRUDED BUILDING FRAME AND BASEBOARD COMBINATION MEMBER

[76] Inventor: Michael J. Wolfe, 2408 Navarey St., Safety Harbor, Fla. 34695

[21] Appl. No.: 08/695,037

[22] Filed: Aug. 9, 1996

[51] Int. Cl.[6] ..... E04H 1/00; E04H 3/00; E04H 5/00

[52] U.S. Cl. ..... 52/242; 52/287.1; 52/288.1; 52/290; 52/220.7; 52/277; 52/279; 52/718.01; 52/718.02; 52/717.03; 52/717.01

[58] Field of Search ..... 52/287.1, 288.1, 52/293.3, 300, 273, 276, 277, 279, 290, 718.01, 718.02, 718.03, 717.03, 717.02, 717.01, 718.04, 106, 242, 220.7

[56] References Cited

U.S. PATENT DOCUMENTS

| | | | |
|---|---|---|---|
| 4,080,766 | 3/1978 | Jastrabek | 52/242 |
| 5,146,723 | 9/1992 | Greenweed et al. | 52/242 X |
| 5,274,972 | 1/1994 | Hansen | 52/242 X |

*Primary Examiner*—Carl D. Friedman
*Assistant Examiner*—W. Glenn Edwards

[57] ABSTRACT

An apparatus suitable for adaptation and use either as an exterior foundational base shroud or an interior decorative baseboard. In either case, the apparatus may be used to conceal and protect electrical, communications, or other conduit. The apparatus is suitable for use with a variety of standardized structural panels and may be manufactured through the extrusion process.

1 Claim, 3 Drawing Sheets

EXTRUDED BUILDING FRAME AND BASEBOARD COMBINATION MEMBER

The invention generally relates to building frame members which are adapted for receiving structural panels, particularly structural panels with sheet metal surfaces and elongated reinforcing steel members. Reference is made to Disclosure Document No. 399540, filed by the inventor on Jun. 25, 1996, which generally describes the enclosed invention, together with frame members adapted to receive similar panels in other building structures.

BACKGROUND OF THE INVENTION

U.S. Pat. No. 5,373,678, issued to Hesser on Dec. 20, 1994, teaches an improved structural panel in which a light-weight structural material is enclosed between two portions of sheet metal and the combinant panel is further strengthened by reinforcing steel bars which are housed and enclosed within the structural panel sheets.

When uniform structural panels are used to construct all or significant portions of a building, it is useful to formulate a standardized means of framing and positioning the various structural panels. A building will only be as strong as its weakest member. Accordingly, it is important to position and frame the structural panels with framing members which are capable of securing and holding the various portions of such building or structure and will also allow the flexibility of providing a variety of building accessories or options.

Aluminum is a useful material for constructing such building frame members. Aluminum has high strength properties for structural metal applications, has a high resistance to corrosion, is easily fabricated, is reasonably light weight, can be welded or mechanically fastened together, and otherwise has properties making it acceptable as a building material. For instance, it does not become permanently magnetized in the presence of a permanent magnetic field.

Aluminum is also desirable for other reasons. For instance, it is easy to work with and fabricate frame members from aluminum. This is because the appropriate alloys or blends of aluminum can be produced by an extrusion process. Extruding is a very efficient and reliable way to fabricate such building components and is desirable.

Standardization is also very helpful in this regard. There are a variety of building components which lend themselves to standardization. For instance, a typical house will have a pitched roof which extends from eave members along opposite sides through a pitched roof to a ridge top. Additionally, a building will normally have an interior baseboard. Most buildings, whether residential or commercial, will also have a need for conduits and passageways through which electrical, communications, and other wiring or cabling may be passed. Finally, most buildings will require a series of windows or other openings along exterior walls. Accordingly, it is helpful to be able to develop standardized apparatus which may be appropriate to each of these purposes.

U.S. Pat. No. 4,075,811, issued to Keith, on Nov. 11, 1976, teaches both a roof panel that is light-weight and structurally strong and also a means of fastening such a roof panel together with nut-and-bolt-type fasteners which are tightened between pairs of structural panels through a protruding-accessory design to hold the frames of the two panels in close proximity with each other and then covered with a shroud. The apparatus taught by Keith can easily be seen to interrupt the continuity of the surface of one or the other side of each pair of structural panels.

U.S. Pat. No. 4,004,373, issued to Eschbach, et al, on Jan. 25, 1977, teaches extrusions for partitions, walls, and enclosures which provide a general "C" frame. Included within the Eschbach patent are a variety of clip-on type connections, which include enclosed shrouds, which are useful in clamping and assembling such structural component panels of a temporary nature, such as the shell of a vehicle. The components of Eschbach are generally capable of manufacture with the extrusion process, but generally do not teach a means and apparatus of securely anchoring a more permanent type building, such as a house, to the foundation nor accommodating it with means of delivering conduit for electricity, communications lines, or other utilities.

U.S. Pat. No. 4,196,555, issued to Henges, on Apr. 8, 1980, teaches another means of linking structural panels which are of a solid-core type. Such includes interlocking frame members. In particular, Henges teaches a corner structure and a means and apparatus of pivoting or providing angled relationships between such structural panels.

The apparatus taught by Henges does not provide for any decorative aspect, nor for the area near the foundation of a wall through which conduit for electrical and communications lines may be passed.

What is not provided in the prior art is an apparatus for serving as the baseboard for an interior wall for a foundational shroud for an exterior wall for a permanent building manufactured of interlocking structural panels. It would also be helpful to have such a baseboard or foundational shroud which can be removed or clipped into place in order to install, remove, or service electrical or communications lines and to conceal and protect such lines from sight or from the elements.

SUMMARY OF THE INVENTION

U.S. Pat. No. 5,373,678, issued to Hesser, on Dec. 20, 1994, teaches a structural wall apparatus. Incorporated within Hesser's structural wall apparatus are building panels which comprise an outer and inner metal skin spaced by an intermediate insulating core of foamed polymer. Each such panel is adapted to have at least one interlocking edge with a metal line tongue in a metal line groove adapted to facilitate interconnection of panels as they are longitudinally interconnected. The panels taught by Hesser also comprise a reinforcing member to the metal skin with a strengthening flange portion on the other side of the metal line groove. Fasteners may be passed through various portions of the interconnecting grooves and flanges in order to facilitate the connection.

While the mechanism taught by Hesser enables adjacent structural panels to interconnect, it does not teach a means of framing the structural panels so as to specifically accommodate certain portions of a building structure, such as the roof, the eaves, the foundational frame members, and the frames for doors and windows.

Such structural panels can be easily fabricated in mass quantities. With appropriate interconnecting members, they can be used for rapid structure of strong and reliable buildings. One of the advantages of such structural panels is in the standardization of the sizes and interconnecting members which not only make them easy to work with but also easy and quick to assemble and train construction workers for accomplishing even what would ordinarily be complicated tasks. Such standardization also facilitates the ability to standardize certain building accessories.

The Inventor has overcome the problems of the prior art by adapting a "C" frame member with apparatus for receiving a shroud member for concealing such electrical, communications, or other conduit or lines which may be necessary to install through a building near the floor or foundation. The assembly taught herein may easily be removed and installed by a variety of means, such as snap-ins or clip-ons.

The apparatus may be manufactured with an anchoring member which is built into the "C" frame or it may comprise a separate member for fastening onto the side of a "C" frame.

It is an object of the present invention to provide a foundational anchor which transfers the positive and negative wind loads to the building foundation.

It is, then, a further object of the present invention to provide a foundational frame member which improves the resistance of structural panel frame to both positive and negative wind load.

It is a further object of the present invention to provide a baseboard or foundational anchor shroud through which electrical or communications or other conduit may be passed.

It is a further object of the present invention to provide such a foundational shroud or baseboard shroud which can be manufactured through the extrusion process.

It is a further object of the present invention to provide such an extruded foundational shroud or baseboard shroud which may simply be installed or removed for servicing.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

Figure 1:
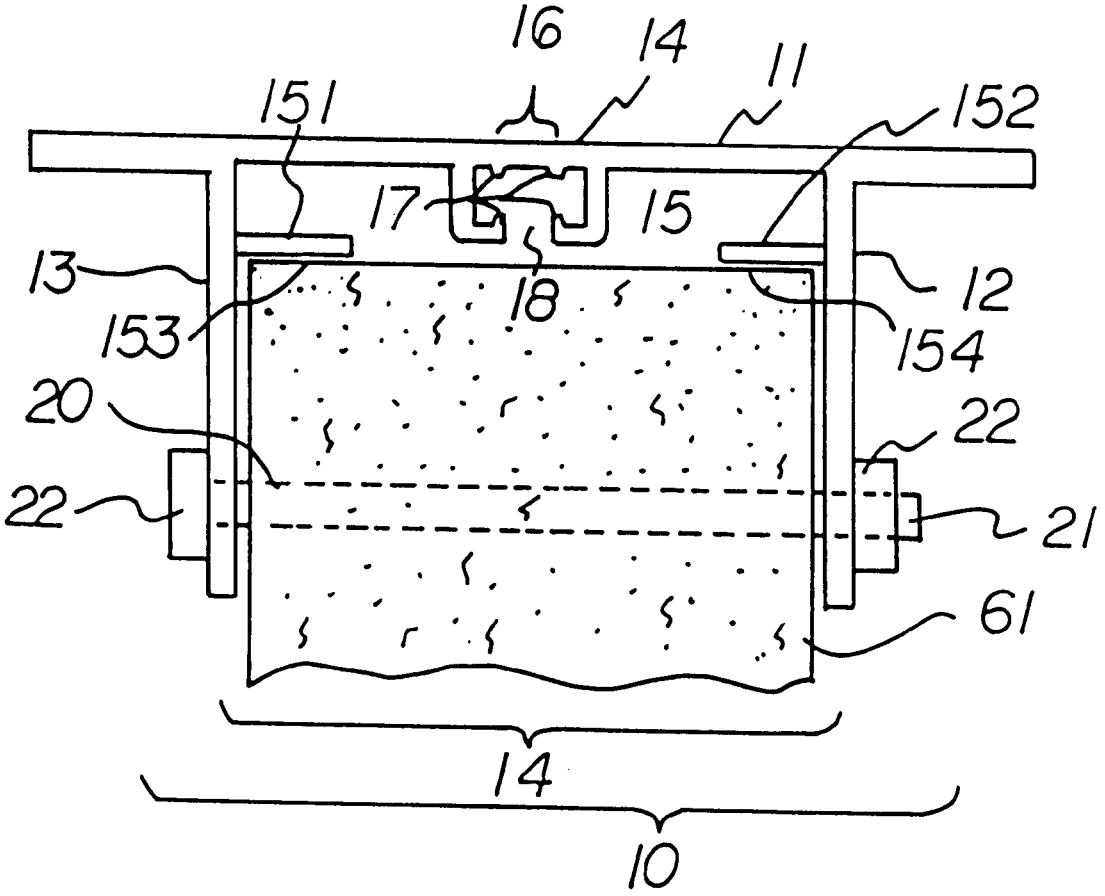
FIG. 1 depicts the cross-section of a standard "C" frame member adapted to frame structural panels.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

As depicted in FIG. 1, a fundamental apparatus for receiving such structural panels is a three-sided frame member which generally describes a "U" or "C" (10). Such would comprise two parallel side members (12, 13) which are joined by a perpendicular base member (11). The spacing (14) between the two side members (12, 13) would be such as to snugly receive a structural panel, such as the one taught by Hesser.

Such a general frame member (10) may easily be manufactured with an extrusion process since all of the surfaces are both straight and uniform. In this manner such a frame member may be fabricated of any desired length and may be cut to any length. Generally speaking, in the extrusion process, an elongated apparatus with a continuous cross section can be manufactured by heating a desired metal (such as an aluminum alloy) and forcing the metal through a cross-sectional die. As the molten aluminum assumes the cross-sectional shape of the form and passes through, it begins to cool and harden. This results in an elongated metallic structure with the desired cross section and of any desired length. This is an efficient and cost-effective means of manufacturing a variety of objects, including frame members, which also produces a consistent structure. Such extrusion method is mentioned by way of general familiarization and is not claimed, in and of itself, as part of this invention. However, the potential for the utilization of extrusion in the practice of this invention is an important consideration when considering its advantages and utility.

While not necessary, as further depicted in FIG. 1, it can be seen that such members may be constructed with a thermal break (15) which reduces the thermal transmission of heat or cold from the outer frame surface to the inner frame surface. This feature is particularly useful for buildings erected in cold climates. The thermal (refer to thermal break U.S. Pat. No. 3,204,324 to "Wilson") break comprises a cavity section (15) with ribbed members (17). The cavity section (15) may be filled with an adhesive binding material (18), such as a liquid urethane, while a portion (16) of the outer cavity (19) can be cut away so as to break the normal continuity in the aluminum frame member (10). The structural integrity of the frame member (10) through this region is now provided by the binding material (18) and a reduction in thermal transmission is achieved while maintaining the structural integrity of the "C" shaped frame member (10) or the structural panel (80) which may be housed within. Such a thermal break (15) may be positioned along the length of any structural panel wall section being contained by the frame section to maintain continuity in the thermally broken and insulated building system.

It should be noted that such thermal breaks can be easily incorporated into an extrusion. It should also be noted that thermal breaks are already well known in the construction art and are not the subject of the present invention. Certain further modifications, innovations, and adaptations of frame members made with thermal breaks, however, are taught herein as means of accomplishing the objectives of the present invention. Such modifications, innovations, and adaptations are the subject of the claims of the present invention.

When a thermal break (15) is used, there is an interruption in the continuity of the base member (11). Depending upon the configuration of a given structural panel (61), this may not pose a problem. It is necessary for the structural panel (61) to rest flat and straight within the frame member (10) and the thermal break may cause a disruption of the structural panel bottom. There may also be situations wherein it is necessary to position a structural frame member (10) more precisely within the frame (10) and apart from the base frame member (11).

In these cases one or two positioning platforms (151, 152) could be positioned and inwardly disposed from either side frame member (12, 13) of the frame (10). Such positioning platforms (151, 152) would have planar surfaces (153, 154) which were perpendicular from the side members (12, 13). If two positioning platforms were to be used, they should line up within the same plane. It can be seen that such positioning platforms (151, 152) could easily be included in an extrusion form.

Additionally, such a frame member (10) is amenable to the placement of fastening screws or bolts (21) at any point along its length. Channels (22) may be drilled which pass through opposite side members (12, 13) of the frame member (10), as well as the encased or framed structural panel (20) which may receive a fastening member (21) to hold the structural panel (20) stable within or between the side members (12, 13) of the frame member (10). This process, which may be referred to as "throughbolting" has the effect of improving the resistance of the frame to both positive and negative wind loads over prior frame members which fastened to structural panel on only one side.

Figure 2:
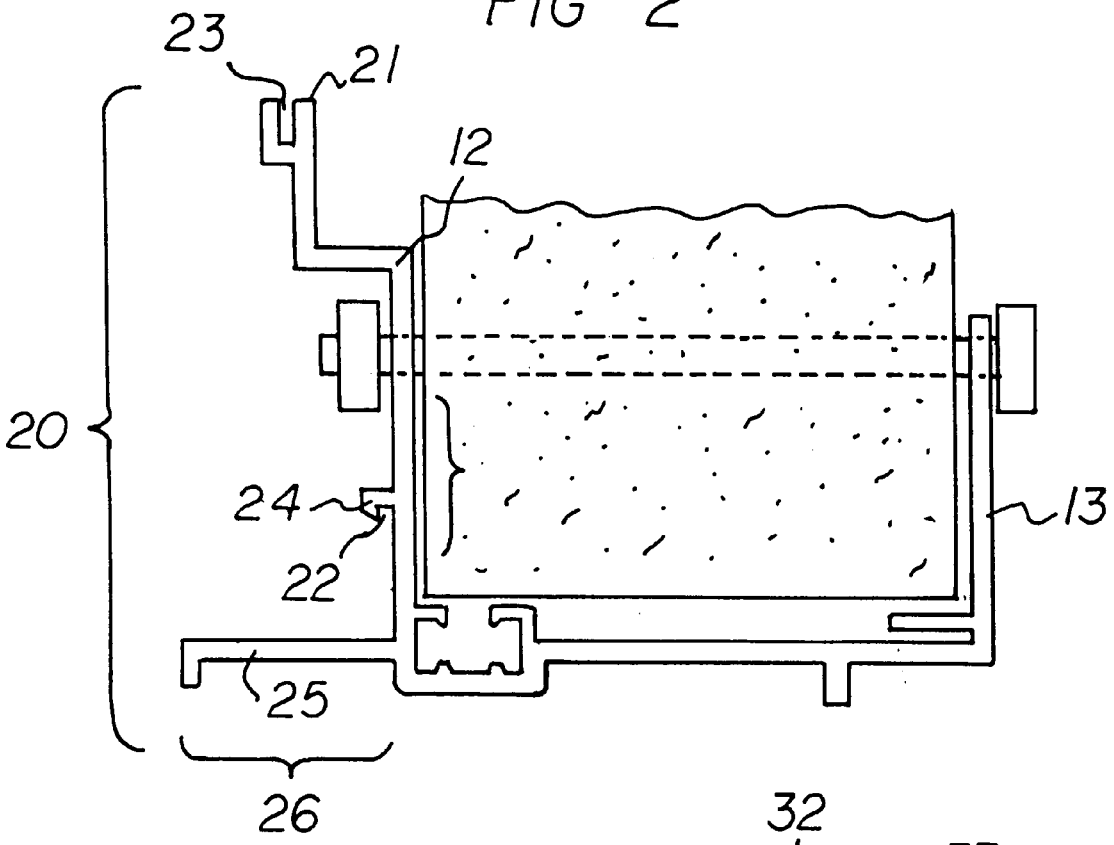
FIG. 2 depicts the cross section of the frame anchor member for a foundational shroud member which is made integral with the foundational frame.

As depicted in FIG. 2, such a "C" frame member may be adapted on either the interior or exterior side with a base plate or baseboard anchor member (20) for receiving and passing electrical, communication or other conduit. As depicted in FIG. 2, one of the side members (12, 13) could be adapted with an offset portion (21) and a snap-in portion (22). The offset portion (21) is adapted with an elongated slot (23). The snap-in portion (22) is adapted with a slanted lower surface (24). The lower or base frame section (25) is extended beyond at least one of the upright side members (12, 13) with an extended length (26).

It can be seen how a shrouding member (30) (please see FIG. 3) can be adapted to snugly and securely fit upon the anchor member (20) in order to provide an acceptable and decorative shroud (31) for electrical, communications, or other conduit not depicted). Such shroud (31) would have an upper portion (32) which ends in a generally flat top portion (33) which is adapted with a elongated and flat protrusion (34). This elongated and flat protrusion (34) is adapted to snugly fit within the elongated slot (23) on the offset portion (21) of the anchor member (20). From the generally flat-top portion (33) may extend a shroud cover (31) which, as depicted in FIG. 2, parallel to a side (27) of the anchor member (20) and generally perpendicular to the flat top portion (33) of the shroud member (30).

While the drawing depicts an arcing shroud member (30), it should be noted that the convergence between the flat top (33) and side (35) of the shroud member (30) could be achieved by having right-angle portions, an angled member from the top portion down to the desired point and/or other similar configurations. Such alternative configurations can easily be understood or conceptualized from this description and are not separately depicted in drawings.

From the shroud side (35) extends an elongated snap-in member (36) which is adapted to cooperate with the anchor member snap receiving portion (22) as follows. The shroud member snap-in portion is adapted with an upper surface which matches the snap-in surface of the base-receiving member. The shroud snap-in member (36) can then be pushed against the anchor snap receiving member (22). The shroud elongated protrusion (37) upon which the snap-in member (36) is fixed may then give sufficiently with the stress of being pushed in to the anchor enabling the shroud snap-in member (36) to pass over the slanted surface (24) of the anchor snap-in portion (22) until it passes it and snaps into place between the anchor member (22) and the snap-receiving member (22).

Figure 4:
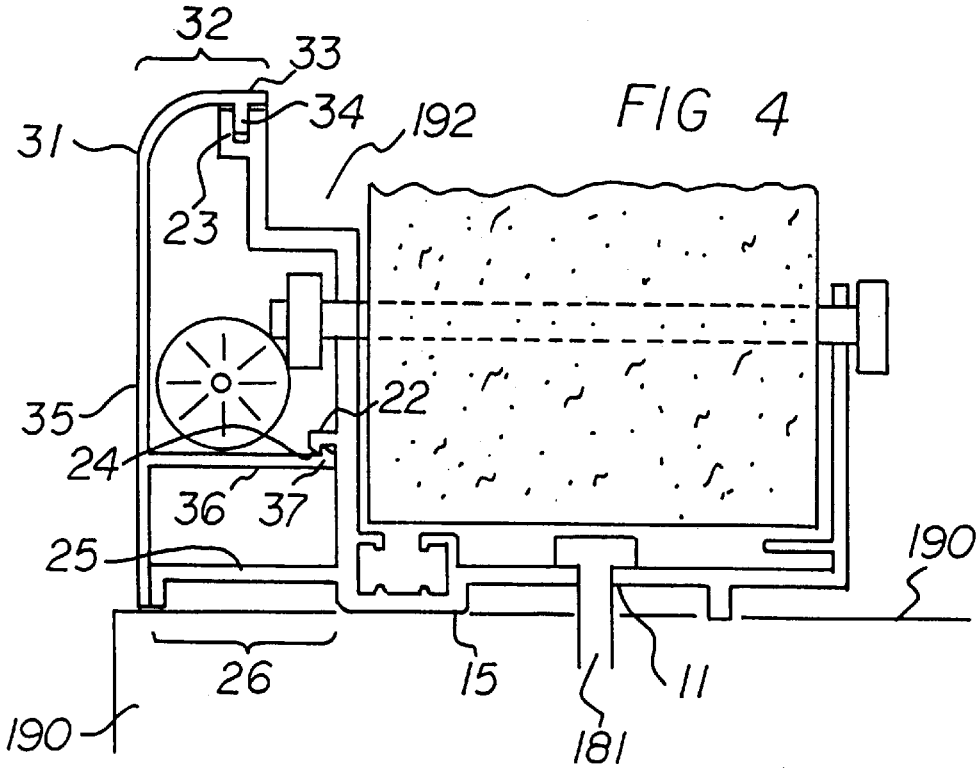
FIG. 4 depicts the anchor and shroud members as interconnected.

The side (35) of the shroud member (30) extends generally down to a point (38) at which it can match up with the elongated end (16) of the base member (11) or, if there is no elongated end to the base member (11), it can be cut or broken to an appropriate length to match up with a floor or other surface (not depicted). FIG. 4 depicts the apparatus as assembled with the cooperating parts in place.

Figure 5:
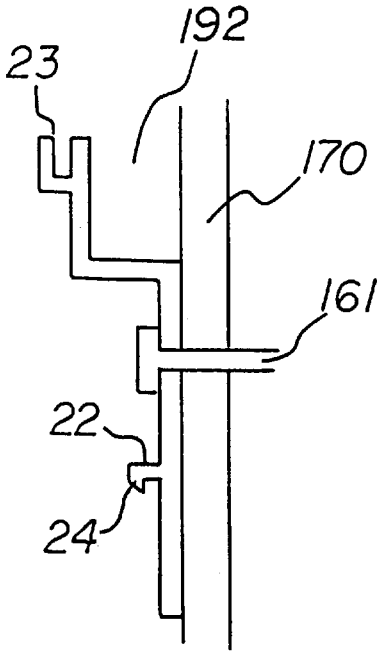
FIG. 5 depicts an anchor member which may be directly fastened to a building stud.
Figure 6:
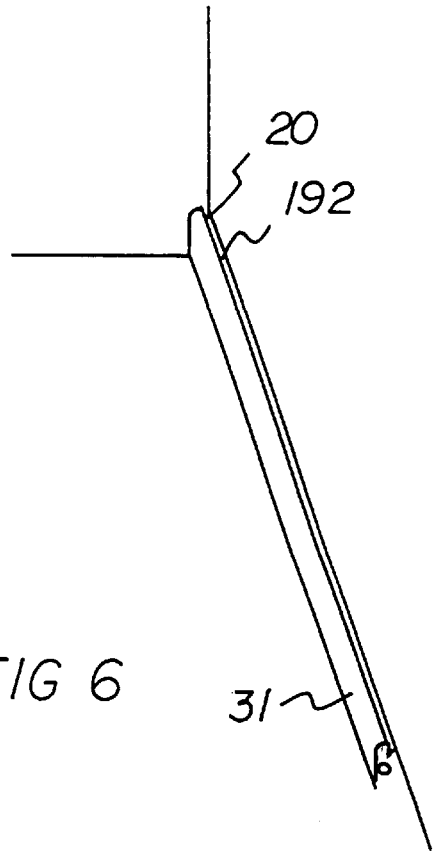
FIG. 6 depicts a baseboard shroud as attached to a wall.

Making reference to FIG. 5, it can be seen that the anchor member for receiving the shroud could be a separate piece bolted onto a building stud (170) rather than built into a structural panel frame as described in FIG. 2. As a fastener (161) will normally be used to hold structural panel (61) into place, the same fastener (161) could be used to hold a shroud receiving apparatus onto a desired stud member (170). In either case the shroud member would function in the same way.

The basic structure of the shroud-receiving member could be accomplished in a number of ways and with a variety of alternative structures which do not deviate from the basic components, which include an elongated slot and snap-receiving member on the base shroud receiving member and an elongated edge and snap-in member on the shroud member.

It should also be noted that the thermal break in this base anchor is not at the center of the base of the "U" member. This enables this thermal expansion to be closer to the center of the full length of the base member. In order to ensure an appropriate leveling of the fastened structural panel, it can be seen that from the interior side of the opposite side member is provided a ledge upon which the outer skin of the structural panel may rest in order to be level with the opposite thermal expansion side.

Figure 3:
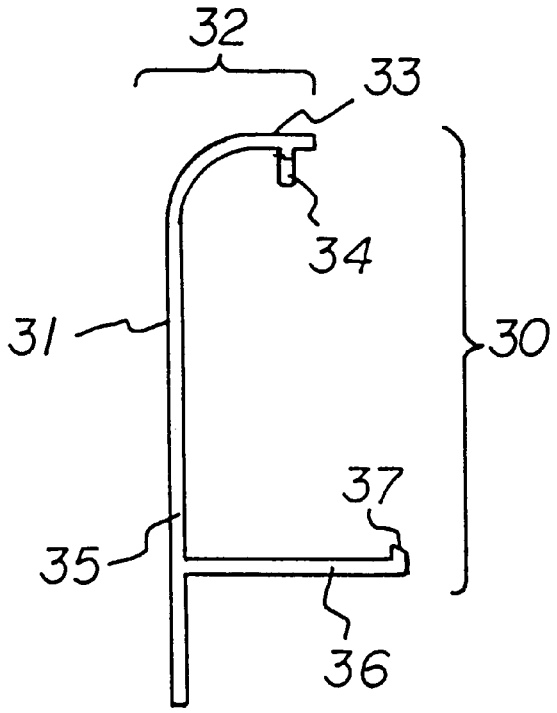
FIG. 3 depicts the cross-section of a foundational shroud member according to the present invention.

The baseplate anchor depicted in FIG. 2 is suitable for use along the foundation of an exterior wall. The structure depicted in FIG. 3 is more suitable for use on the baseboard of an interior wall. In either case, however, the general structure is the same and the function is the same, namely to provide a continuous and attractive surface which can be used to shroud the desired electrical, communications, or other conduit. It should be noted that the lower portion of the base member of the exterior wall baseplate anchor may further be adapted with means of leveling it with the thermal expansion or providing a better fit along the outside of a foundation.

While the apparatus herein has been taught for use with a structural panel of the type of Hesser, it should be noted that such could be used with a variety of structural components, including solid-core structural panels, structural beams (such as four by four wood members commonly used for major frame portions of wooden structures), composite panels; and a variety of others. These frame members have particularly been adapted for use with the Hesser-type panels because a need existed to provide more secure and versatile framing of structural panels which included metal skins and foam interiors. The panels taught herein have thermal expansions which generally are adaptable to fit within a foam material. It should also be noted that for thinner structural panel-type components a thermal expansion may not be needed. In such a case an offset could be provided simply to accommodate a fastener or the offset could be disposed of altogether.

Thermal breaks should not be considered a necessary part of the invention as taught herein, but have been included the descriptions and drawings in order to demonstrate that the principles of the present invention can work with buildings of a thermal break design.

Generally speaking, these frames may be adapted to accept panel thicknesses ranging from about two inches to ten inches. When manufactured of aluminum through the extrusion process, they may be manufactured from aluminum of high-strength alloys commonly known as 6005, 6061, or 6063.

The drawings and descriptions further have depicted some rather specific geometrical shapes for the adaptations which receive the conduit shroud. It can readily be seen that these specific geometrical shapes are not critical to the invention, but what is critical to the invention is that some receiving channel or area be provided to receive the desired structural component, whether it be a conduit or an edge for framing a door or a window.

It is also possible to replace or substitute another fastening means for the snap-in members presently taught at the bottom of the shroud. For instance, the lower end of the shroud and the lower end of the anchor member could be adapted with some combination of cooperating slot and edge members to allow the shroud to be slid into position along the lower foundational frame anchor. This would be somewhat less convenient, but would be more stable. Moreover, such a double slot combination could most likely be used only with exterior walls. It should be noted that the lower slot and edge could be reversed so that the edge could be positioned upon the lower portion of either the anchoring member or the lower interior portion of the shroud member and cooperate with a slot positioned on the facing side of the other member.

Additionally, the anchor or shroud members could have a lower protruding positioning edge of sufficient width to just hold the shroud in place by gravity. Such an apparatus could be given additional stability by simply driving a long screw through the shroud which may extend and be turned into the anchor member as well.

Making reference again to FIG. 4, two important modifications of the apparatus should be discussed. First is that, when the foundational member is being used as a true foundation, one or more foundational anchor bolts (181) could be used in order to secure the frame and the wall to the building foundation (190). This would almost always be the case when the present invention is used on the ground floor of a structure and could also be used for upper floors, if desired. Additionally, the various forms of the anchor shroud apparatus taught here have included an upper pocket (192), which is created by positioning the upper slot (23) away from the structural panel (61). This pocket (192) may be used to receive drywall or other wall coverings as desired. It would, however, be possible to practice the present invention with no such pocket. In that case, the entire anchor shroud would rest flush against the structural panel. This need not be depicted herein, but should be understood as an alternative which is in keeping within the spirit and scope of the present invention.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. An elongated foundational frame shroud apparatus for providing a concealed space along the lower portion of a wall comprising structural panels, said foundational shroud member comprising;

a foundational frame member, said foundational frame member further comprising a side member and an elongated shroud anchoring member which are adapted to receive the bottom portion of a vertical wall and a foundational base, said foundational base being adapted to connect said side members and to receive the bottom edge of a vertical wall structural panel, the foundational frame member including a thermal break;

said elongated shroud anchoring member adapted to run along the length of one said side member, said shroud anchoring member further comprising an elongated upper edge receiving slot, said upper edge receiving slot running at the top of said shroud anchoring member and being at all points parallel to the length of said foundational member and defining a slot which is open at the top and generally perpendicular to the ground and parallel to said shroud anchoring member, said upper edge receiving slot being offset from said structural panel side in order to form an elongated pocket for receiving the bottom edge of a sheet of drywall or wallboard, and a lower elongated snap receiving member, said lower elongated snap receiving member further comprising an elongated snap receiving channel which further comprises an elongated short connecting member which runs along the length of said anchoring member and is at all points perpendicular to the side of said shroud anchoring member and upon which is downwardly disposed a short snap receiving member, said short snap receiving member ending with an elongated slanted surface, said elongated slanted surface being slanted from an outward point down to an inward point near said shroud anchoring member, said side member and said elongated shroud anchoring member including one or more pairs of holes, each said pair of holes being opposite from each other, each pair of holes being adapted to receive a fastener which may be used to secure a structural panel within said foundational frame and shroud member;

an elongated shroud member, said elongated shroud member having an elongated upper surface from which is downwardly disposed an elongated protruding edge, said elongated protruding edge adapted to be received and snugly fit within said elongated anchoring member upper edge receiving slot, said shroud further being disposed with an outer surface which generally extends down from said elongated upper side and away from said anchoring member to a lower portion, said lower portion further being adapted with an elongated planar snap joining member, said snap joining member further being adapted with an upwardly disposed snap-in member, said snap-in member having a slanted upper surface which is slanted from an upper point which is towards the interior surface of said shroud member to a lower point which is more distant from the interior surface of said shroud, said joining member being of an appropriate length to permit said snap-in member to be pushed along so that the upper slanted surface of said snap-in member can be, under pressure while said shroud upper edge is within said anchor upper edge receiving slot, forced over said anchor member slanted surface until the entire shroud member slanted surface has passed along the entire width of said anchoring slanted surface and said upwardly disposed shroud snap-in member can snap into the channel between said anchoring member slanted surface and the anchoring member side;

said anchoring member side, said shroud upper surface, said shroud exterior side member, and said joining member further defining an elongated opening of sufficient size through which electrical, communications, or other conduit may be passed to a desired point along the foundation of said structural panel building.

* * * * *